US012662766B2

(12) United States Patent
Park et al.

(10) Patent No.: US 12,662,766 B2
(45) Date of Patent: Jun. 23, 2026

(54) WASHING MACHINE AND METHOD FOR CONTROLLING THE SAME

(71) Applicant: SAMSUNG ELECTRONICS CO., LTD., Suwon-si (KR)

(72) Inventors: Sukwoo Park, Suwon-si (KR); Minjoo Kim, Suwon-si (KR); Changju Oh, Suwon-si (KR); Sangyeol Lee, Suwon-si (KR); Jaepoong Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 230 days.

(21) Appl. No.: 18/367,812

(22) Filed: Sep. 13, 2023

(65) Prior Publication Data

US 2024/0141578 A1 May 2, 2024

Related U.S. Application Data

(63) Continuation of application No. PCT/KR2023/012575, filed on Aug. 24, 2023.

(30) Foreign Application Priority Data

Nov. 2, 2022 (KR) ..... 10-2022-0144814

(51) Int. Cl.
*D06F 39/08* (2006.01)
*D06F 33/34* (2020.01)
(Continued)

(52) U.S. Cl.
CPC ..... *D06F 39/088* (2013.01); *D06F 33/34* (2020.02); *D06F 39/087* (2013.01); *D06F 2103/18* (2020.02); *D06F 2105/02* (2020.02)

(58) Field of Classification Search
None
See application file for complete search history.

(56) References Cited

U.S. PATENT DOCUMENTS 10,077,523 B2 9/2018 Im et al.
11,578,453 B2 * 2/2023 Leonard ..... D06F 39/087
(Continued)

FOREIGN PATENT DOCUMENTS

JP 8-196777 8/1996
JP 5801949 10/2015
(Continued)

OTHER PUBLICATIONS

International Search Report dated Dec. 20, 2023, in PCT Application No. PCT/KR2023/012575.
(Continued)

*Primary Examiner* — Cristi J Tate-Sims
(74) *Attorney, Agent, or Firm* — STAAS & HALSEY LLP

(57) ABSTRACT

A washing machine including a tub; a water supply valve configured to open or close a flow path to supply water to the tub; and a controller configured to (a) control the water supply valve to supply water to the tub to a target water level, (b) determine whether water pressure of the water supply valve is normal based on supplying the water to the tub to the target water level, (c) based on determining that the water pressure of the water supply valve is abnormal, update water pressure information that includes water pressure and water supply operation time of the water supply valve by adjusting the water supply operation time, and (d) set the updated water pressure information to be used for controlling the water supply valve in an operation course of the washing machine.

20 Claims, 12 Drawing Sheets

(51) Int. Cl.
*D06F 103/18* (2020.01)
*D06F 105/02* (2020.01)

(56) References Cited

U.S. PATENT DOCUMENTS

| | | | | |
|---|---|---|---|---|
| 11,739,458 | B2 | 8/2023 | Koo et al. | |
| 2010/0011514 | A1* | 1/2010 | Park | D06F 34/18 8/159 |
| 2019/0010648 | A1 | 1/2019 | Han et al. | |
| 2019/0309460 | A1* | 10/2019 | Yoon | G05B 13/026 |
| 2020/0087839 | A1* | 3/2020 | White | D06F 33/43 |
| 2020/0199804 | A1* | 6/2020 | Magnusson | D06F 33/34 |
| 2023/0175191 | A1 | 6/2023 | Lee et al. | |

FOREIGN PATENT DOCUMENTS

| | | |
|---|---|---|
| JP | 2018-11810 | 1/2018 |
| JP | 2020-429 | 1/2020 |
| JP | 2020-175187 | 10/2020 |
| JP | 2022-106415 | 7/2022 |
| KR | 95-18882 | 7/1995 |
| KR | 10-1996-0037948 | 11/1996 |
| KR | 10-1998-0019755 | 6/1998 |
| KR | 2000-0033351 | 6/2000 |
| KR | 10-0319689 | 3/2002 |
| KR | 10-0335093 | 6/2002 |
| KR | 2003-0016462 | 3/2003 |
| KR | 10-2010-0099585 | 9/2010 |
| KR | 10-2012-0073588 | 7/2012 |
| KR | 10-2014-0008707 | 1/2014 |
| KR | 10-2019-0005414 | 1/2019 |
| KR | 10-2020-0095981 | 8/2020 |
| KR | 10-2021-0088956 | 7/2021 |
| KR | 10-2023-0086843 | 6/2023 |

OTHER PUBLICATIONS

Written Opinion dated Dec. 20, 2023, in PCT Application No. PCT/KR2023/012575.

* cited by examiner

WASHING MACHINE AND METHOD FOR CONTROLLING THE SAME

CROSS-REFERENCE TO RELATED APPLICATIONS

This is a continuation application, filed under 35 U.S.C. § 111 (a), of International Application PCT/KR2023/012575, filed Aug. 24, 2023, it being further noted that foreign priority benefit is based upon Korean Patent Application No. 10-2022-0144814, filed Nov. 2, 2022, in the Korea Intellectual Property Office, the disclosures of which are incorporated by reference herein in their entireties.

BACKGROUND

1. Field

The disclosure relates to a washing machine for washing, rinsing and dehydrating clothes.

2. Description of Related Art

A washing machine may include a tub and a drum rotationally installed in the tub and do the laundry by rotating the drum containing clothes inside the tub. Various operation courses are provided to operate the washing machine. For example, a washing course including a washing process to wash clothes, a rinsing process to rinse the washed clothes, and a dehydrating process to dehydrate the clothes is provided. In the washing process and rinsing process, a water supply operation for supplying water into the tub is performed.

The traditional washing machine operates based on operation settings preset in the product manufacturing stage for various operation courses. For example, when the traditional washing machine performs the washing course, the whole operation time of the washing machine is provided for the user based on the preset water supply time, laundry time and drain time.

However, there is a need for setting a variable operation time of the washing machine depending on many different environments in which the user actually uses the washing machine. For example, in a low water pressure environment, the water supply time needs to be adjusted and notified to the user. When the water supply time is not adjusted despite a change in water pressure, laundry performance may be degraded. Furthermore, there may be a difference between a water supply time actually taken in the low water pressure environment and the preset water supply time. In this case, the whole operation time notified to the user may be different from an actual operation time, which may cause the user to feel uncomfortable.

SUMMARY

According to an embodiment of the disclosure, a washing machine may include a tub; a water supply valve configured to open or close a flow to supply water to the tub; and a controller configured to (a) control the water supply value to supply water to the tub to a target water level, (b) determine whether water pressure of the water supply valve is normal based on supplying the water to the tub to the target water level, (c) based on determining that the water pressure of the water supply value is abnormal, update water pressure information that includes water pressure and water supply operation time of the water supply valve by adjusting the water supply operation time, and (d) set the updated water pressure information to be used for controlling the water supply valve in an operation course of the washing machine.

According to an embodiment of the disclosure, the controller may be configured to enter a tub cleaning course, and the controller may be configured to control of the water supply valve to supply water to the tub to the target water level, determine whether the water pressure of the water supply valve is normal based on supplying the water to the tub to the target water level, update the water pressure information by adjusting the water supply operation time, and set the updated water pressure information, when in the tub cleaning course. Moreover, to determine whether water pressure of the water supply valve is normal based on supplying the water to the tub to the target water level, the controller may detect actual water supply time used to supply water to the target water level after start of water supply through the water supply valve, and determine whether water pressure of the water supply valve is normal by comparing the detected actual water supply time and a reference time.

According to an embodiment of the disclosure, the operation course may be a washing course of clothes or a rinsing course of the clothes to be performed after the tub cleaning course.

According to an embodiment of the disclosure, to determine whether water pressure of the water supply valve is normal based on supplying the water to the tub to the target water level, the controller may be configured to detect actual water supply time used to supply water up to the target water level after start of water supply through the water supply valve, and determine whether water pressure of the water supply valve is normal by comparing the detected actual water supply time and a reference time.

According to an embodiment of the disclosure, to set the updated water pressure information to be used for controlling the water supply valve in an operation course of the washing machine, the controller may be configured to set the updated water pressure information to be used in a scheduled water supply operation to be performed while a washing course of clothes or a rinsing course of clothes is being performed.

According to an embodiment of the disclosure, the controller may perform a drain operation to a preset minimum water level based on determining that the water pressure of the water supply valve is abnormal, detect water resupply time used to supply water from the preset minimum water level to the preset target water level, and adjust water supply operation time of the water supply valve based on the detected water resupply time.

According to an embodiment of the disclosure, the controller may be configured to determine that the water supply valve is in an abnormal state based on a water level in the tub not increasing after a start of water supply through the water supply valve.

According to an embodiment of the disclosure, the washing machine may further include a filter in the flow path to filter foreign materials in water, and the controller may be configured to store an accumulated number of times of determining that water pressure of the water supply valve is abnormal, and determine that the filter is clogged based on the accumulated number of times exceeding a threshold number.

According to an embodiment of the disclosure, the controller may be configured to determine that the tub has a leak based on reduction in water level after a preset stabilization time elapses from when the water level in the tub reaches the target water level.

According to an embodiment of the disclosure, the washing machine may further include a communication interface configured to communicate with an external user device, and the controller may be configured to control the communication interface to provide a notification about abnormal water pressure of the water supply valve and adjustment of the water supply operation time.

According to an embodiment of the disclosure, a method may be provided of controlling a washing machine including a tub, a water supply valve configured to open or close a flow path to supply water to the tub, and a controller. The method may include, by the controller: controlling the water supply valve to supply water to the tub to a target water level; determining whether water pressure of the water supply valve is normal based on supplying the water to the tub to the target water level; based on determining that the water pressure of the water supply valve is abnormal, updating water pressure information that includes water pressure and water supply operation time of the water supply vale by adjusting the water supply operation time; and setting the updated water pressure information to be used for controlling the water supply valve in an operation course of the washing machine.

According to an embodiment of the disclosure, the method may further include, by the controller, entering a tub cleaning course, wherein the controlling, the determining, the updating, and the setting are performed when in the tub cleaning course. Moreover, the determining whether the water pressure is normal may include detecting actual water supply time used to supply water to the target water level after start of water supply through the water supply valve; and determining whether water pressure of the water supply valve is normal by comparing the detected actual water supply time and a reference time.

According to an embodiment of the disclosure, the operation course may be a washing course of clothes or a rinsing course of the clothes to be performed after the tub cleaning course.

According to an embodiment of the disclosure, the determining whether the water pressure is normal may include detecting actual water supply time used to supply water to the target water level after start of water supply through the water supply valve; and determining whether water pressure of the water supply valve is normal by comparing the detected actual water supply time and a reference time.

According to an embodiment of the disclosure, the setting the updated water pressure information may include setting the updated water pressure information to be used in a scheduled water supply operation to be performed while a washing course of the clothes or a rinsing course of the clothes is being performed.

According to an embodiment of the disclosure, updating the water pressure information may include performing a drain operation to a preset minimum water level based on the water pressure of the water supply valve determined as abnormal; detecting water resupply time used to supply water from the minimum water level to the target water level; and adjusting water supply operation time of the operation valve based on the detected water resupply time.

According to an embodiment of the disclosure, determining of whether the water pressure is normal may further include determining that the water supply valve is in an abnormal state based on the water level in the tub not increasing after a start of water supply through the water supply valve.

According to an embodiment of the disclosure, the washing machine may further include a filter in the flow path to filter foreign materials in water, and the determining whether the water pressure is normal may further include storing an accumulated number of times of determining that water pressure of the water supply valve is abnormal; and determining that the filter is clogged based on the accumulated number of times exceeding a threshold number.

According to an embodiment of the disclosure, the determining whether the water pressure is normal may further include determining that the tub has a leak based on reduction in water level after a preset stabilization time elapses from when the water level in the tub reaches the target water level.

According to an embodiment of the disclosure, the method may further include controlling a communication interface to provide a notification about abnormal water pressure of the water supply valve and adjustment of the water supply operation time to an external user device.

DETAILED DESCRIPTION

Figure 1:
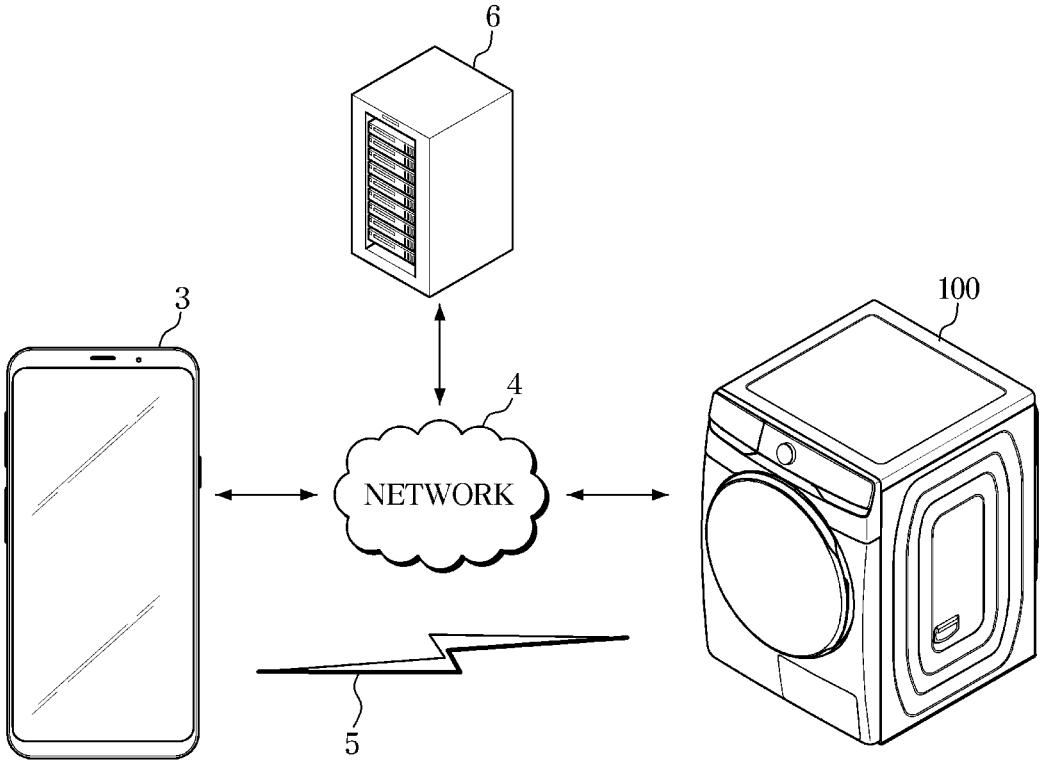
FIG. 1 illustrates a home appliance system, according to an embodiment of the disclosure.

Embodiments and features as described and illustrated in the disclosure are merely examples, and there may be various modifications replacing the embodiments and drawings at the time of filing this application.

It will be further understood that the term "connect" or its derivatives refer both to direct and indirect connection, and the indirect connection includes a connection over a wireless communication network.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "comprise" and/or "comprising," when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or room discussed below could be termed a second element, component, region, layer or section without departing from the teachings of the disclosure.

Furthermore, the terms, such as "— part", "— block", "— member", "— module", etc., may refer to a unit of handling at least one function or operation. For example, the terms may refer to at least one process handled by hardware such as field-programmable gate array (FPGA)/application specific integrated circuit (ASIC), etc., software stored in a memory, or at least one processor.

Reference numerals used for method steps are just used to identify the respective steps, but not to limit an order of the steps. Thus, unless the context clearly dictates otherwise, the written order may also be practiced otherwise.

According to various embodiments of the disclosure, a washing machine and method for controlling the washing machine are provided, by which determination of whether water pressure for each of a plurality of water supply valves is normal may be made, water pressure information may be updated according to a change in water pressure, and a water supply operation time for each water supply valve may be adjusted.

According to various embodiments of the disclosure, a washing machine and method for controlling the washing machine are provided, by which different water pressure determination methods may be used depending on operation courses and a use timing of the water pressure information updated according to the operation course may be differently set.

According to various embodiments of the disclosure, a washing machine and method for controlling the washing machine may prevent degradation of laundry performance and provide whole operation time of the washing machine or time left until completion of the operation of the washing machine more accurately by adjusting water supply operation time of each of the plurality of water supply valves in consideration of a change in water pressure.

Furthermore, according to various embodiments of the disclosure, water pressure of each of the plurality of water supply valves may be determined without an extra flowmeter, and even an abnormal state of the water supply valve, clogging of filters and tub leakage may be detected in the process of determination of the water pressure and notified to the user.

Reference will now be made in detail to embodiments of the disclosure, which are illustrated in the accompanying drawings.

FIG. 1 illustrates a home appliance system 1, according to an embodiment.

Referring to FIG. 1, the home appliance system 1 may include an external user device 3 and a washing machine 100. The external user device 3 may include a portable communication device (e.g., a smart phone), a computer, a portable multimedia device, or a wearable device. The external user device 3 may also be referred to as a mobile device.

The washing machine 100 refers to a device for caring/cleaning clothes. The home appliance system 1 may also include other types of home appliances than the washing machine 100. For example, the washing machine 100 may also include a garment care device capable of deodorizing, sterilizing, dusting, unwrinkling and drying clothes without washing.

The washing machine 100 may be operated based on an operation course selected through a control panel 110 or an external user device 3. For example, the operation course may include various courses such as a tub cleaning course, a washing course, a rinsing course and a drying course. The washing course may be determined to be standard washing, intense washing, laundry stripping, quick washing or eco-washing. For each operation course, at least one of washing time, water supply time, drain time, dehydration time, and a target water level may be set differently.

The washing machine 100 and the external user device 3 may communicate with each other through a first network 4 (e.g., a long-range wireless communication network) or a second network 5 (e.g., a short-range wireless communication network). Furthermore, the washing machine 100 and the external user device 3 may communicate with an external server 6 through the first network 4.

The external user device 3 may obtain a user input, and transmit a control signal corresponding to the user input to the washing machine 100 through the external server 6. The washing machine 100 may receive the control signal transmitted from the external user device 3 through the external server 6, and perform an operation corresponding to the control signal.

The external user device 3 may include an application for controlling the washing machine 100. The external user device 3 may transmit a control signal to the washing machine 100 through the external server 6 based on a user input obtained by executing the application. Furthermore, the external user device 3 may display a user interface UI that enables control of the washing machine 100. The user interface may include a graphic user interface (GUI). The user may use the external user device 3 to operate the washing machine 100.

Figure 2:
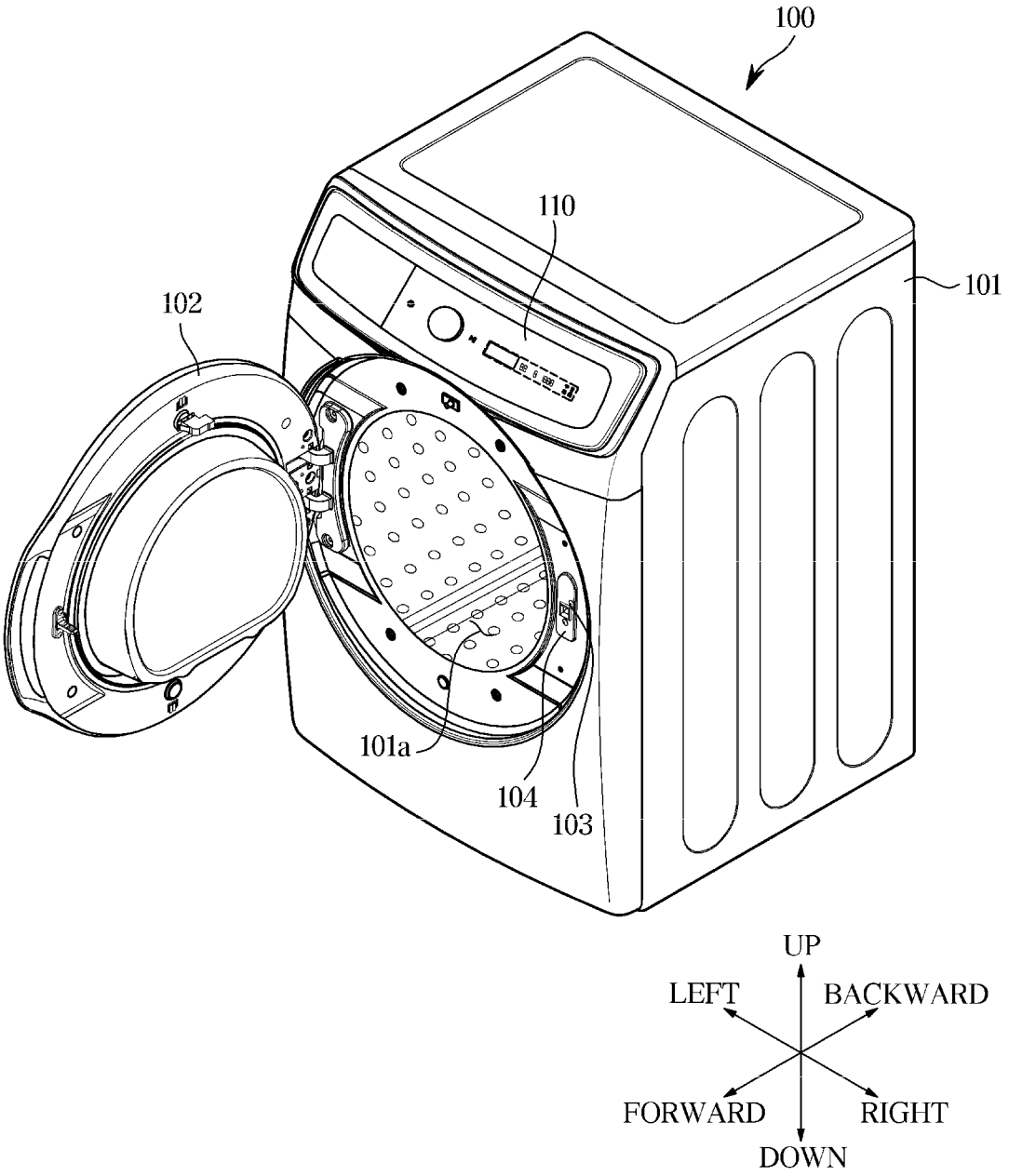
FIG. 2 illustrates an exterior of a washing machine, according to an embodiment of the disclosure.
Figure 3:
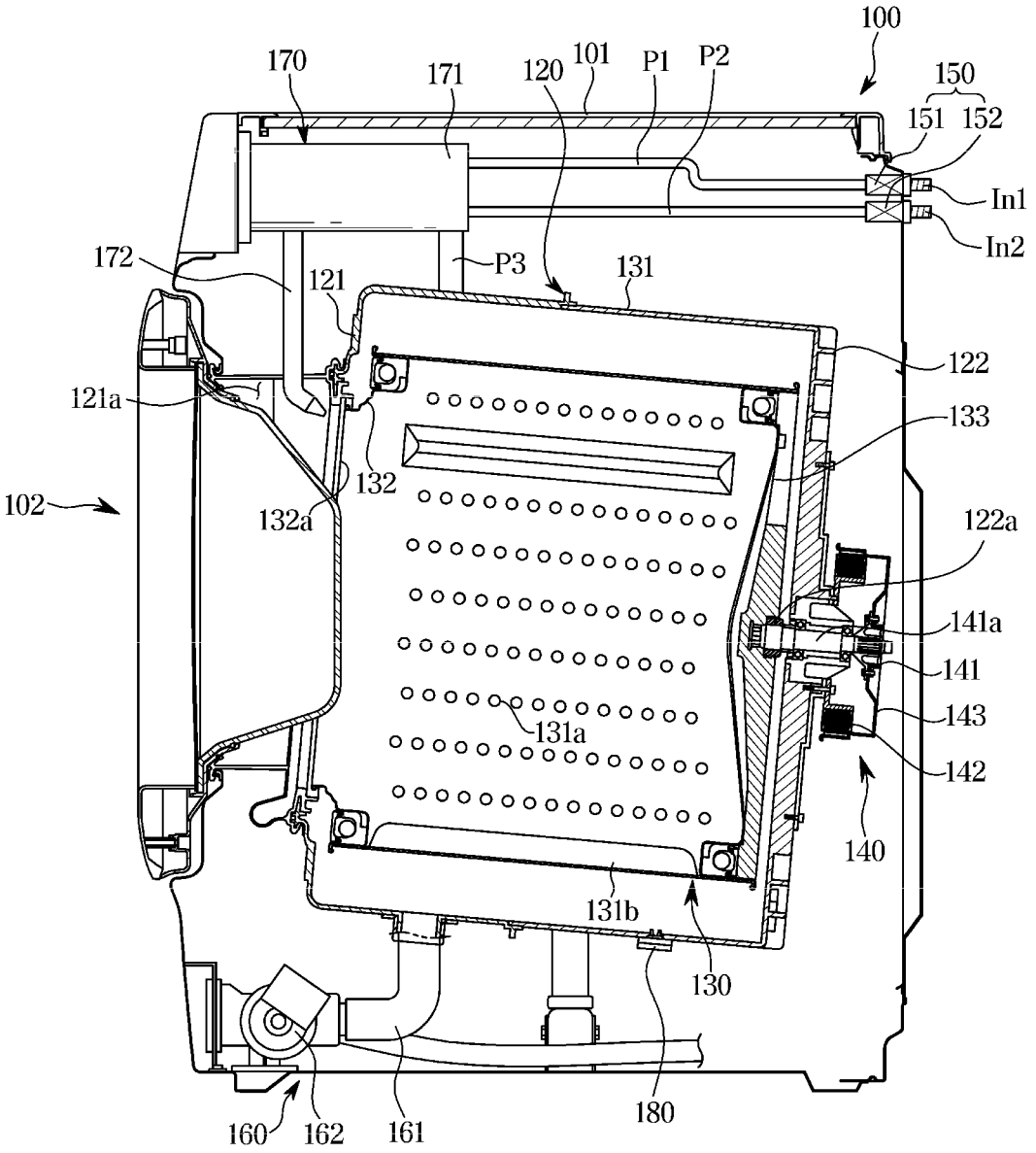
FIG. 3 is a side cross-sectional view of a washing machine, according to an embodiment of the disclosure.

FIG. 2 illustrates an exterior of a washing machine, according to an embodiment. FIG. 3 is a side cross-sectional view of a washing machine, according to an embodiment.

Referring to FIGS. 2 to 3, the washing machine 100 may include a cabinet 101 and a door 102 arranged on the front of the cabinet 101. An inlet 101*a* may be formed in the middle of the front side of the cabinet 101 to draw in or out the laundry (or also referred to as clothes). The door 102 may be provided to open or close the inlet 101*a*. The door 102 may be mounted with a hinge to pivot on one side. That the inlet 101*a* is closed by the door 102 may be detected by a door switch 103. When the inlet 101*a* is closed and the washing machine 100 operates, the door 102 may be locked by a door lock 104.

The washing machine 100 may also include a control panel 110, a tub 120, the drum 130, a driver 140, a water supplier 150, a drain 160, a detergent supplier 170 and a water level sensor 180.

The control panel 110 including an input for obtaining a user input and a display for displaying operation information of the washing machine 100 may be arranged in an upper portion of the front side of the cabinet 101. The control panel 110 may provide the user with a user interface to interact with the washing machine 100.

The tub 120 may be arranged inside the cabinet 101 and may contain water for washing and/or rinsing. The tub 120 may include tub front parts 121 with an opening 121*a* formed on the front and tub rear parts 122 in the shape of a cylinder with a closed rear side. The opening 121*a* through which to draw in or out clothes to or from the drum 130 may be formed on the tub front parts 121. A bearing 122*a* is arranged on the rear wall of the tub rear parts 122 to rotationally fix a drum motor 141.

The drum 130 may be rotationally arranged in the tub 120 and may contain the clothes to be washed. The drum 130 may include a cylindrical drum body 131, drum front parts 132 arranged on the front of the drum body 131 and drum rear parts 133 arranged on the back of the drum body 131. The tub 120 and the drum 130 may be positioned at an angle to the ground. However, it is also possible that the tub 120 and the drum 130 are positioned to be parallel with the ground.

On the inner surface of the drum body 131, through holes 131*a* connecting the inside of the drum 130 to the inside of the tub 120 and a lifter 131*b* for lifting the clothes up the drum 130 during rotation of the drum 130 may be arranged. An opening 132*a* through which to draw in or out clothes to or from the drum 130 may be formed on the drum front parts 132. The drum rear parts 133 may be connected to a shaft 141*a* of the drum motor 141 that rotates the drum 130.

The drum motor 141 may rotate the drum 130. The drum motor 141 may include the driver 140. The drum motor 141 may be arranged on the outside of the tub rear parts 122 and connected to the drum rear parts 133 through the shaft 141*a*. The shaft 141*a* may penetrate the tub rear parts 122 and may be rotationally supported by the bearing 122*a* arranged on the tub rear parts 122.

The drum motor 141 may include a stator 142 fixed on the outside of the tub rear parts 122 and a rotor 143 rotationally arranged and connected to the shaft 141*a*. The rotor 143 may be rotated by magnetic interaction with the stator 142, and the rotation of the rotor 143 may be delivered to the drum 130 through the shaft 141*a*. The drum motor 141 may include, for example, a brushless direct current motor (BLDC motor) or a permanent synchronous motor (PMSM) capable of easily controlling the rotation speed.

The water supplier 150 may supply water to the tub 120 and the drum 130. The water supplier 150 may include a plurality of water supply tubes P1 and P2 that form flow paths connected to external water supply sources to supply water to the tub 120. For example, the plurality of water supply tubes P1 and P2 may include the first water supply tube P1 that forms a cold water flow path to supply cold water and the second water supply tube P2 that forms a hot water flow path to supply hot water. The first water supply tube P1 may be referred to as a cold water tube, and the second water supply tube P2 may be referred to as a hot water tube.

The first water supply tube P1 and the second water supply tube P2 may be arranged above the tub 120. An end of the first water supply tube P1 may be connected to a first water supply inlet In1 connected to a first external water supply source. The first external water supply source may be a cold water source. The other end of the first water supply tube P1 and an end of the second water supply tube P2 may be connected to a detergent container 171. The water may flow to the tub 120 via the detergent container 171. The other end of the second water supply tube P2 may be connected to a second water supply inlet In2 connected to a second external water supply source. The second external water supply source may be a hot water source. The first water supply inlet In1 may be connected to the external cold water source through a separate hose. The second water supply inlet In2 may be connected to the external hot water source through a separate hose.

The plurality of water supply tubes P1 and P2 may be connected to a plurality of water supply valves 151 and 152, respectively. The plurality of water supply valves 151 and 152 may open or close the plurality of flow paths to supply water to the tub 120. The first water supply valve 151 may be connected to the first water supply tube P1, and may open or close a flow path (first flow path) formed by the first water supply tube P1. The second water supply valve 152 may be connected to the second water supply tube P2, and may open or close a flow path (second flow path) formed by the second water supply tube P2.

Furthermore, the water supplier 150 may include a plurality of filters (not shown) arranged in the plurality of flow paths, respectively, for filtering foreign materials contained in water. For example, the filter may be arranged at each of the first water supply inlet In1 and the second water supply inlet In2. The filter may be clogged when foreign materials are accumulated on the filter, and due to the clogging of the filter, flows of water may be blocked. Hence, the filter needs to be periodically replaced. The filter is not an essential component of the washing machine 100.

Each of the plurality of water supply valves 151 and 152 may be opened or closed in response to an electric signal from a controller 200. In other words, each of the plurality of water supply valves 151 and 152 may allow or block the supply of water into the tub 120 from the external water source. For example, the first water supply valve 151 and the second water supply valve 152 may include a solenoid valve that is opened or closed in response to an electric signal.

The drain 160 may drain out the water stored in the tub 120 and/or the drum 130. The drain 160 may include a drain tube 161 extending from the bottom of the tub 120 to the outside of the cabinet 101, and a drain pump 162 arranged at the drain tube 161. The drain pump 162 may pump the water in the drain tube 161 out of the cabinet 101.

The detergent supplier 170 may supply a detergent to the tub 120 and/or the drum 130. The detergent supplier 170 may be arranged above the tub 120 and may include the detergent container 171 for storing a detergent and a mixing tube P3 that connects the detergent container 171 to the tub 120. The detergent container 171 may be connected to the first water supply tube P1 and the second water supply tube P2. The water supplied through the first water supply tube P1 and the second water supply tube P2 may be mixed with the detergent of the detergent container 171. The mixture of the detergent and the water may be supplied to the tub 120 through the mixing tube P3.

Furthermore, a nozzle 172 may be provided to supply water in which no detergent is contained into the tub 120. The nozzle 172 may inject water into the drum 130. The nozzle 172 may form a different flow path from the mixing tube P3.

For example, the nozzle 172 may be connected to the detergent container 171. In this case, a switching valve (not shown) may be arranged in the detergent container 171 to change the flow path of water. As the switching valve is operated under the control of the controller 200, the mixing tube P3 and the nozzle 172 may be selectively opened.

There may be at least one nozzle 172 arranged. In another example, the nozzle 172 may not be connected to the detergent container 171, but branched from each of the first water supply tube P1 and/or the second water supply tube P2 to extend up to the opening 132*a* of the drum 130. In the case that the nozzle 172 is branched from each of the first water supply tube P1 and/or the second water supply tube P2, a switching valve may be arranged at each intersection.

The water level sensor 180 may be arranged underneath the tub 120. The water level sensor 180 may detect a water level in the tub 120. The water level sensor 180 may detect the frequency that changes according to the water level. The water level sensor 180 may detect the water level in the tub 120 based on the frequency corresponding to internal pressure of the tub 120.

Figure 4:
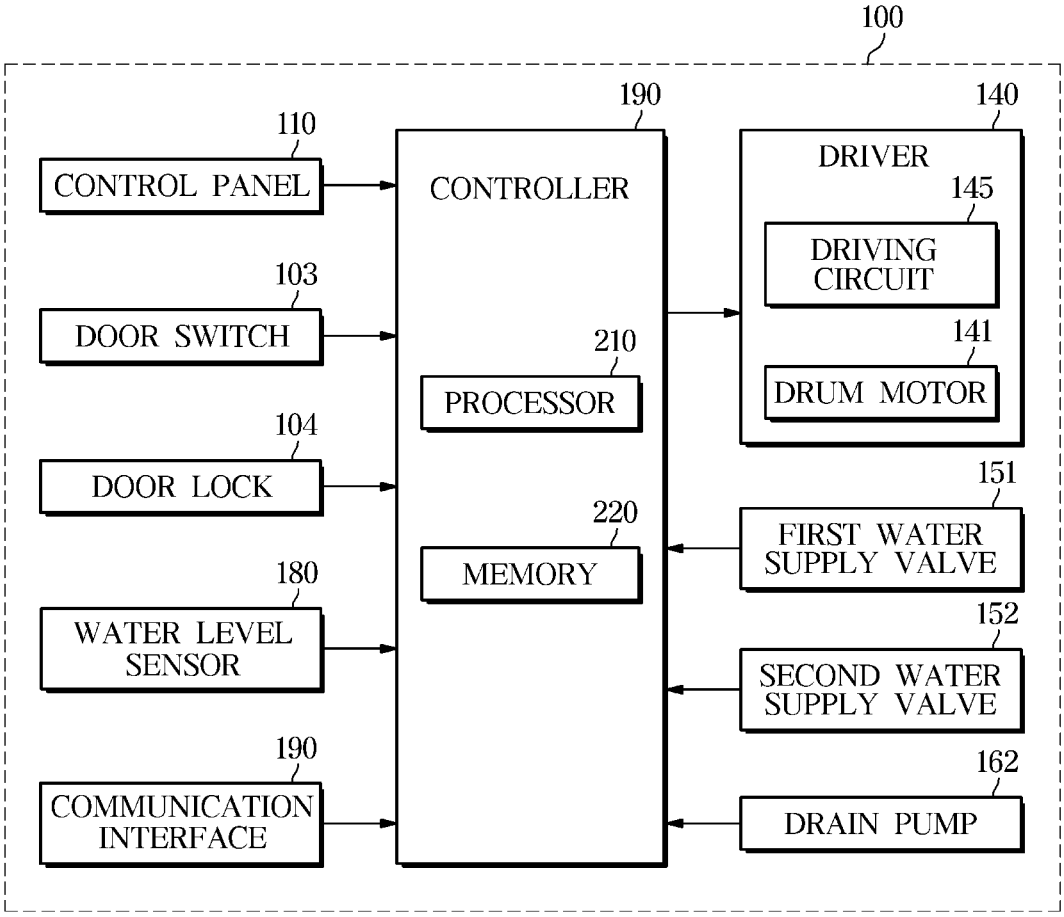
FIG. 4 is a block diagram of components of a washing machine, according to an embodiment of the disclosure.

FIG. 4 is a block diagram of components of a washing machine, according to an embodiment.

Referring to FIG. 4, the washing machine 100 may include not only the mechanical components as described in connection with FIGS. 2 and 3 but also electrical components. The washing machine 100 may include the door switch 103, the door lock 104, the control panel 110, the driver 140, the first water supply valve 151, the second water supply valve 152, the drain pump 162, the water level sensor 180, the communication interface 190 and the controller 200. The controller 200 may be electrically connected to the components of the washing machine 100 to control the respective components.

The door switch 103 may detect a closed state of the door 102 and an open state of the door 102. For example, the door switch 103 may be opened (turned off) in the open state of the door 102 and closed (turned on) in the closed state of the door 102. The door switch 103 may transmit a signal indicating the closed state of the door 102 or a signal indicating the open state of the door 102 to the controller 200.

The door lock 104 may lock the door 102 in response to a locking signal from the controller 200. For example, when the door 102 closes the inlet 101*a* and the washer 100 operates, the controller 200 may control the door lock 104 to lock the door 102.

The control panel 110 may include an input button for obtaining a user input, and a display for displaying a laundry setting and/or laundry operation information in response to the user input. The control panel 110 may provide the user with a user interface to interact with the washing machine 100. The control panel 110 may be provided in various forms at various locations on the washing machine 100 based on the design.

The input button may include, for example, a power button, a start button, a course selection dial, and a detailed setting button. The input button may also include a tact switch, a push switch, a slide switch, a toggle switch, a micro switch, or a touch switch.

The display may display information relating to an operation of the washing machine 100. The display may display information input by the user or information to be provided for the user in various screens. The display may display information regarding an operation of the washing machine 100 in at least one of an image or text. The display may display a GUI that enables control of the washing machine 100. For example, the display may include a screen for displaying a laundry course selected by turning the course selection dial and the operation time of the washing machine 100, and an indicator for indicating detailed settings selected by the setting button.

The display may include a display panel of various types. For example, the display may include a liquid crystal display (LCD) panel, a light emitting diode (LED) panel, an organic LED (OLED) panel, or a micro LED panel. The display may include a touch screen to be used as an input device as well.

The driver 140 may include the drum motor 141 and a driving circuit 145. the drum motor 141 may rotate the drum 130 under the control of the controller 200. The controller 200 may drive the drum motor 141 to follow a target rotation speed.

The driving circuit 145 may apply a driving current to the drum motor 141 for driving the drum motor 141 in response to a driving signal (a motor control signal) of the controller 200. The driving circuit 145 may rectify and convert alternate current (AC) power from an external power source to direct current (DC) power, and convert the DC power to sinusoidal driving power.

The driving circuit 145 may include an inverter for outputting the converted driving power to the drum motor 141. The inverter may include a plurality of switching devices, and open (turn off) or close (turn on) the plurality of switching devices based on a driving signal from the controller 200. A driving current may be applied to the drum motor 141 according to the opening or closing of the switching devices. Furthermore, the driving circuit 145 may include a current sensor (not shown) for measuring a driving current output from the inverter.

The controller 200 may calculate rotation speed of the drum motor 141 based on an electrical angle of the rotor. The electrical angle of the rotor may be obtained from a position sensor (not shown) equipped on the drum motor 141. For example, the controller 200 may calculate the rotation speed of the drum motor 141 based on an extent of a change in the electrical angle of the rotor for a sampling time interval. The position sensor may be implemented by a hall sensor, an encoder, or a resolver that is able to measure a position of the rotor 143 of the drum motor 141. Furthermore, the controller 200 may calculate the rotation speed of the drum motor 141 based on a driving current value measured by the current sensor (not shown).

The washing machine 100 may include a plurality of water supply valves. The plurality of water supply valves may be controlled separately. For example, the washing machine 100 may include the first water supply valve 151 and the second water supply valve 152. The first water supply valve 151 may be connected to the first water supply tube P1, and may open or close a flow path formed by the first water supply tube P1. The second water supply valve 152 may be connected to the second water supply tube P2, and may open or close a flow path formed by the second water supply tube P2. The first water supply valve 151 may also be referred to as a cold water valve. The second water supply valve 152 may also be referred to as a hot water valve.

The drain pump 162 may discharge the water out of the cabinet 101 through the drain tube 161 in response to a drain signal from the controller 200. By the operation of the drain pump 162, the water stored in the tub 120 may be discharged out of the cabinet 101 through the drain tube 162.

The water level sensor 180 may detect a water level in the tub 120. The water level sensor 180 may detect the frequency that changes according to the water level. The water level sensor 180 may detect the water level in the tub 120 based on the frequency corresponding to internal pressure of the tub 120. For example, as the water level increases, pressure in the tub 120 increases and frequency decreases. On the contrary, as the water level decreases, pressure in the tub 120 decreases and frequency increases. The water level sensor 180 may transmit an electric signal corresponding to the water level in the tub 120 to the controller 200.

The communication interface 190 may support establishment of a communication channel or a wireless communication channel with the external user device 3 or the external server 6 and communication through the established communication channel. The communication interface 190 may include one or more processors for supporting wired communication or wireless communication. The communication interface 190 may be implemented by various communication technologies. For example, the communication interface 190 may include a wireless communication module and/or a wired communication module. The wireless communication module may support a wireless LAN, a home radio frequency (RF), infrared communication, ultra-wide band (UWB) communication, Wi-Fi, Wi-Fi Direct, Bluetooth, AD-HOC and/or Zigbee.

The controller 200 may include a processor 210 for generating a control signal for an operation of the washing machine 100, and a memory 220 for storing a program, an application, instructions and/or data for operation of the washing machine 100. The processor 210 and the memory 220 may be implemented with separate semiconductor devices or in a single semiconductor device. Furthermore, the controller 200 may include a plurality of processors or a plurality of memories. The controller 200 may be provided in various positions inside the washing machine 100. For example, the controller 200 may be included in a printed circuit board (PCB) arranged in the control panel 110.

The processor 210 may include an operation circuit, a storage circuit, and a control circuit. The processor 210 may include one or multiple chips. Furthermore, the processor 210 may include one or multiple cores.

The processor 210 may process data and/or a signal based on the program provided from the memory 220, and transmit a control signal to each component of the washing machine 100 based on the processing result. For example, the processor 210 may output control signals to control the door lock 104, the drum motor 141, the water supply valves 151 and 152 and the drain pump 162 to perform a washing course based on a user input received through the control panel 110 or the communication interface 190.

The memory 220 may store a program for performing an operation according to an operation course of the washing machine 100 and data including an operation setting according to the operation course. Furthermore, the memory 220 may store an operation course currently selected based on a user input and the operation setting. The memory 220 may include a volatile memory, such as a static random access memory (S-RAM) or a dynamic RAM (D-RAM), and a non-volatile memory, such as a read only memory (ROM) or an erasable programmable ROM (EPROM). The memory 220 may include a memory device, or multiple memory devices.

The memory 200 may store water pressure information including water pressure of each of the plurality of water supply valves 151 and 152 and corresponding water supply operation time. The first water supply valve 151 and the second water supply valve 152 may be connected to different external water supply sources. For each water supply valve, a different water supply operation time may be stored. For example, the first water supply operation time for the first water supply valve 151 may be determined to be long as the water pressure is low. When each external water supply source has different water pressure, the water pressure information may be different for each of the first water supply valve 151 and the second water supply valve 152.

The controller 200 may control the drum motor 141, the water supply valves 151 and 152 and the drain pump 162 to perform a washing course, a rinsing course and a dehydrating course. Furthermore, the controller 200 may control the control panel 110 and/or the communication interface 190 to provide laundry settings and laundry operation information to the user.

Figure 5:
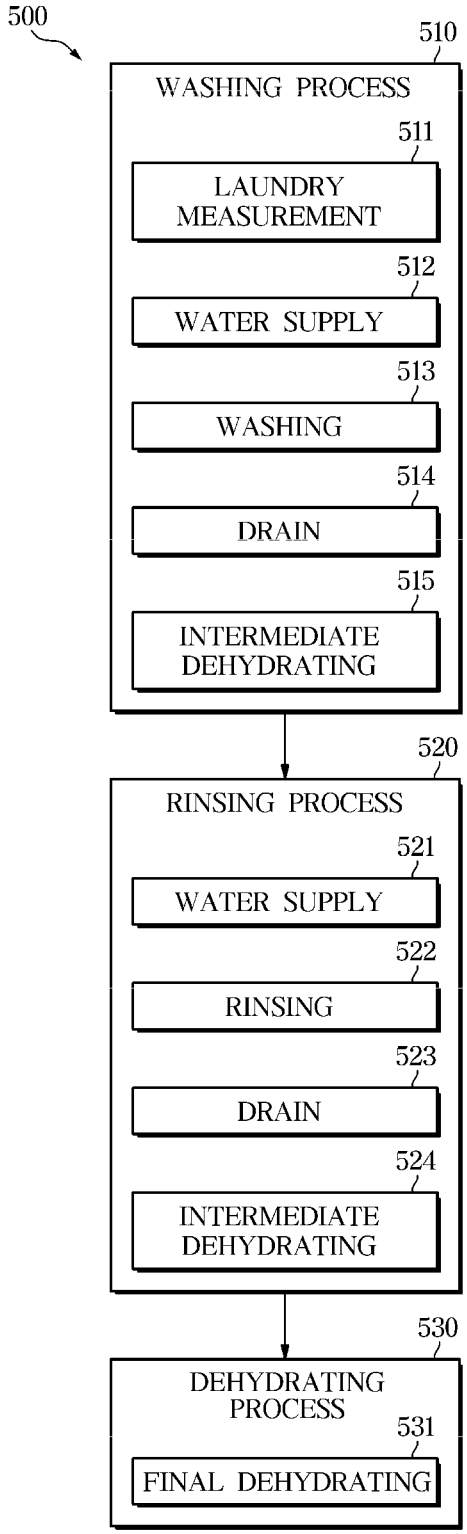
FIG. 5 illustrates a washing course of a washing machine, according to an embodiment of the disclosure.

FIG. 5 illustrates overall operations of a washing machine, according to an embodiment.

Referring to FIG. 5, the controller 200 of the washing machine 100 may control the components of the washing machine 100 to perform a washing course 500 set by a user input. The washing course 500 may include preset washing settings (e.g., laundry temperature, the number of rinsing times, and dehydration intensity) depending on the type of clothes (e.g., shirts, pants, underwear, or bedclothes), the texture of the clothes (e.g., cotton, polyester or wool) and an amount of the clothes.

For example, a standard washing course may include universal laundry settings for clothes. A bedcloth washing course may include laundry settings optimized to wash bedclothes. There may be various washing courses such as standard washing, powerful washing, wool washing, bedclothes washing, infant clothes washing, towel washing, minimal washing, boiling washing, economic washing, outdoor clothes washing, rinsing plus dehydrating, dehydrating, etc.

That is, the washing course 500 may be configured to sequentially perform a washing process 510, a rinsing process 520 and a dehydrating process 530. Clothes may be washed in the washing process 510. In the washing process 510, dirt on the clothes may be separated by chemical actions of a detergent and/or mechanical actions such as falling.

The washing process 510 may include a laundry measurement operation 511 for measuring an amount of clothes, a water supply operation 512 for supplying water into the tub 120, a washing operation 513 for washing the clothes by rotating the drum 130 at low speed, a draining operation 514 for draining water contained in the tub 120, and an intermediate dehydrating operation 515 for separating water from the clothes by rotating the drum 130 at high speed. In the washing operation 513, the controller 200 may rotate the drum motor 141 in forward direction or reverse direction. Due to the rotation of the drum 130, the clothes may fall down the drum 130.

In the intermediate dehydrating operation 515, the controller 200 may rotate the drum motor 141 at high speed. Due to the high-speed rotation of the drum 130, water may be separated from the clothes. The rotation speed of the drum 130 may gradually increase during the intermediate dehydrating operation 515.

The clothes may be rinsed by the rinsing process 520. Specifically, the remnant of the detergent or dirt on the clothes may be removed. The rinsing process 520 may include a water supply operation 521 for supplying water into the tub 120, a rinsing operation 522 for rinsing the clothes by driving the drum 130, a draining operation 523 for draining water contained in the tub 120, and an intermediate dehydrating operation 524 for separating water from the clothes by driving the drum 130.

The water supply operation 521, draining operation 523 and intermediate dehydrating operation 524 of the rinsing process 520 may correspond to the water supply operation 512, draining operation 514 and intermediate dehydrating operation 515 of the washing process 510. The water supply operation 521, the rinsing operation 522, the drain operation 523 and the intermediate dehydrating operation 524 included in the rinsing process 520 may each be performed one or more times.

Water contained in the clothes may be separated from the clothes through the dehydrating process 530. The water may be separated from the clothes by high-speed rotation of the drum 130, and the separated water may be discharged out of the washing machine 100. The dehydrating process 530 may include a final dehydrating operation 531 to separate water from the clothes by rotating the drum 130 at high speed.

In an embodiment, after the intermediate dehydrating operation 524 of the rinsing course 520 is performed, the final dehydrating operation 531 of the dehydrating process 530 may be performed. The rotation speed of the drum 130 for the intermediate dehydrating operation 524 may be lower than the rotation speed for the final dehydrating operation 531. In another embodiment, the final dehydrating operation 531 may replace the last intermediate dehydrating operation 524 of the rinsing process 520.

To perform the final dehydrating operation 531, the controller 200 may control the driving circuit 145 to rotate the drum motor 141 at high speed. The rotation speed of the drum motor 141 may gradually increase during the final dehydrating operation 531. Due to the high-speed rotation of the drum 130, water may be separated from the clothes contained in the drum 130 and drained out of the washing machine 100. When the final dehydrating operation 531 is completed, the operation of the washing machine 100 is stopped. Time for performing the final dehydrating operation 531 may be set to be longer than the time for performing the intermediate dehydrating operation 515 or 524.

General operation of the washing machine 100 is described based on the washing course 500, but the washing machine 100 may perform an extra rinsing course according to a user input. The rinsing course may include the rinsing process 520 and the dehydrating process 530 without the washing process 510.

Furthermore, the washing machine 100 may perform a tub cleaning course. The tub cleaning course is to clean the tub 120 while the drum 130 contains no laundry (i.e., in an unloaded state). By performing the tub cleaning course, contaminants stuck to the tub 120 and the drum 130 may be removed. The tub cleaning course may include a water supply operation for supplying water into the tub 120, a cleaning operation for cleaning the drum 130 and the tub 120 by rotating the drum 130, and a drain operation.

There may be other various operation courses for the washing machine 100.

Figure 6:
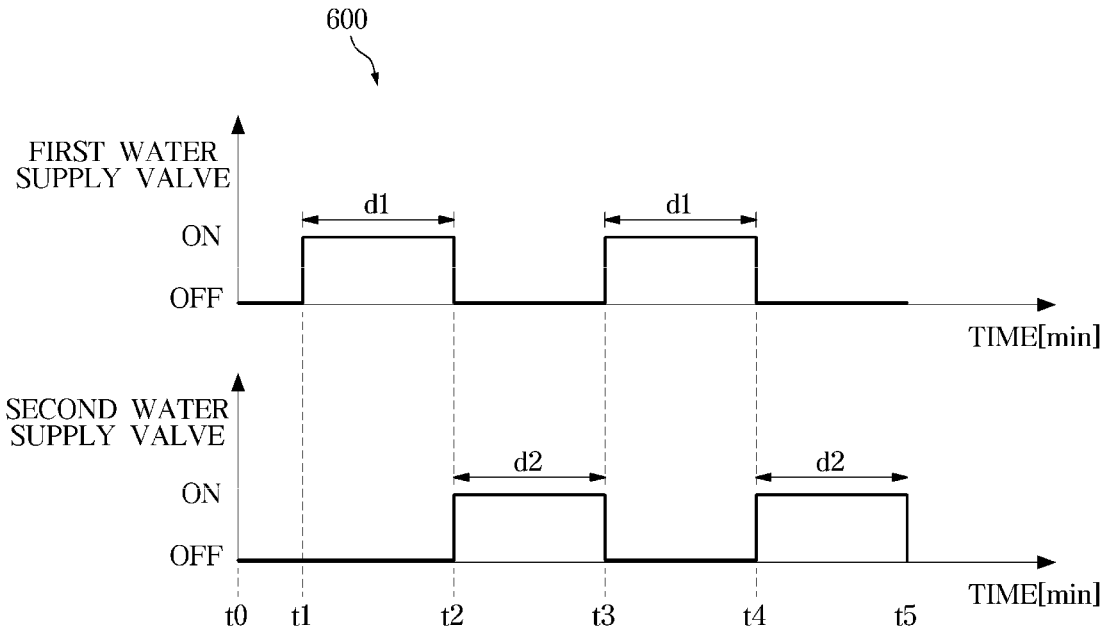
FIG. 6 illustrates graphs for describing a default operation of water supply valves during a water supply operation of a washing machine, according to an embodiment of the disclosure.

FIG. 6 illustrates graphs 600 for describing a default operation of water supply valves during a water supply operation of the washing machine, according to an embodiment.

In FIG. 6, described is how to perform a water supply operation in an environment where water pressure of the first water supply valve 151 and water pressure of the second water supply valve 152 are in a normal range and the water pressure is constant.

The water supply operation may be performed until the water level in the tub 120 reaches a preset target water level. Time required to supply water up to the target water level after the start of water supply may be defined as water supply time. The target water level may be set differently for each operation course of the washing machine 100.

To supply water into the tub 120 during a water supply operation, the controller 200 of the washing machine 100 may control the first water supply valve 151 and the second water supply valve 152. The controller 200 may control the first water supply valve 151 and the second water supply valve 152 based on water pressure information stored in the memory 220. The water pressure information may include water pressure and corresponding water supply operation time for each of the first water supply valve 151 and the second water supply valve 152. Time for supplying water for the water supply operation may be determined as a sum of the water supply operation times of the water supply valves 151 and 152.

Referring to the graphs 600 of FIG. 6, when the water of a preset temperature (e.g., 40° C.) is set to be used for the washing process, the controller 200 may control the water supply valves 151 and 152 to alternately supply cold water and hot water into the tub 120. The first water supply valve 151 to open or close the cold water flow path and the second water supply valve 152 to open or close the hot water flow path may be operated in rotation. It is illustrated that opening and closing of the water supply valves 151 and 152 are performed twice each in rotation.

Unlike what is shown in FIG. 6, when the washing machine 100 is set to use only cold water, only the operation of the first water supply valve 151 may be controlled and the second water supply valve 152 is controlled to remain in the closed state. When the washing machine 100 is set to use only hot water, only the operation of the second water supply valve 152 may be controlled and the first water supply valve 151 may be controlled to remain in the closed state.

In FIG. 6, 'ON' refers to opening of the first water supply valve 151 and the second water supply valve 152 to open the flow path of water. On the contrary, 'OFF' refers to closing of the first water supply valve 151 and the second water supply valve 152 to close the flow path of water.

When the water supply operation begins, the controller 200 may open the first water supply valve 151 first at time t1 to supply cold water into the tub 120. The first water supply valve 151 may remain in the open state until time t2. That is, cold water may be supplied into the tub 120 for a time period d1 from time t1 to time t2. Subsequently, to supply hot water into the tub 120, the controller 200 may close the first water supply valve 151 and open the second water supply valve 152 at time t2. The second water supply valve 152 may remain in the open state until time t3. That is, hot water may be supplied into the tub 120 for a time period d2 from time t2 to time t3. Furthermore, from time t3 to time t4, cold water may be supplied into the tub 120 as the first water supply valve 151 is opened and the second water supply valve 152 is closed. From time t4 to time t5, hot water may be supplied into the tub 120 as the second water supply valve 152 is opened and the first water supply valve 151 is closed.

In FIG. 6, time for supplying water for the water supply operation corresponds to a period from time t1 to time t5. For example, the water supply time may be 12 minutes. Furthermore, a first water supply operation time 2*d1 for the first water supply valve 151 and a second water supply operation time 2*d2 may each be 6 minutes. The water supply operation time for a water supply valve may refer to the whole time for maintaining the water supply valve in the open state in a single water supply operation.

As the water pressure of the first water supply valve 151 and the water pressure of the second water supply valve 152 are in a normal range, a preset water supply time may be equal to an actual water supply time. In other words, when each water pressure of the water supply valves 151 and 152 is in the normal range, the water level in the tub 120 reaches the target water level by performing the water supply operation for the preset water supply time.

Although it was described that the first water supply operation time 2*d1 for the first water supply valve 151 and the second water supply operation time 2*d2 are the same, it is not limited thereto. The time section d1 for which the first water supply valve 151 is opened and the time section d2 for which the second water supply valve 152 is opened may be set differently. Furthermore, the water supply operation time for each water supply valve may be adjusted according to a change in use environment (e.g., a change in water pressure) or a state of each water supply valve.

In general, the water supply time for a water supply operation and the water supply operation time of each of the water supply valves 151 and 152 are determined in advance based on water pressure of an external water supply source connected to the washing machine 100 in a design stage of the washing machine 100 being in the normal range. The entire operation time of the washing machine 100 or the time left until the end of the operation of the washing machine 100 is also determined based on a preset water supply time. The washing machine 100 may provide the user with information about the entire operation time or the time left. The normal range of water pressure may be differently determined depending on the location and region where the washing machine 100 is installed.

When the external water supply source has water pressure below the normal range, the water level in the tub 120 may not reach the target water level even when the water supply operation is performed for the preset water supply time. In this case, the controller 200 of the washing machine 100 may additionally perform the water supply operation to increase the water level in the tub 120 up to the target water level. This may cause a gap between the actual water supply time and the preset water supply time. Furthermore, it may also cause a gap between the operation time of the washing machine 100 notified to the user and an actual operation time of the washing machine 100. Moreover, when the water supply time determined in the design stage continues to be used without reflecting the change in water pressure, inaccurate information about the operation time of the washing machine 100 may be constantly provided to the user. Hence, the user may feel inconvenience.

To solve the problem, the washing machine 100 as disclosed herein may adjust the water supply operation time for at least one water supply valve based on water pressure of the at least one water supply valve determined as abnormal. Furthermore, the washing machine 100 may update the water pressure information stored in the memory 220 for the adjusted water supply operation time to be used later. The washing machine 100 may control the communication interface 190 to provide the user with a notification about abnormal water pressure of the at least one water supply valve and adjustment of the water supply operation time.

The controller 200 of the washing machine 100 may determine whether water pressure of each of the water supply valves 151 and 152 is normal by comparing an actual water supply time and a preset reference time. The reference time may refer to the previous water supply time stored in the memory 220.

For example, when the actual water supply time used to supply water up to the preset target water level after the start of water supply through the first water supply valve 151 is longer than the reference time, the controller 200 may determine that the water pressure of the first water supply valve 151 is abnormal (i.e., low pressure).

In the tub cleaning course for cleaning the tub 120, all the plurality of water supply valves 151 and 152 may be determined whether they have normal water pressure. The controller 200 may detect actual water supply time used to supply water up to the preset target water level after the start of water supply through each of the plurality of water supply valves 151 and 152 in the tub cleaning course, and determine whether water pressure of each of the plurality of water supply valves 151 and 152 is normal by comparing the detected actual water supply time and the preset reference time.

In the washing course or rinsing course of clothes, the controller 200 may determine an operation valve to be used for the water supply operation based on the operation settings of the washing machine 100 and/or a user input. At least one of the first water supply valve 151 and the second water supply valve 152 may be determined to be the operation valve. The water supply valve which is not the operation valve may remain in the closed state until an operation thereof is requested. The controller 200 may determine whether the water pressure of the at least one water supply valve determined as the operation valve is normal. The controller 200 may detect actual water supply time used to supply water up to the preset target water level after the start of water supply through the operation valve, and determine whether the water pressure of the operation valve is normal by comparing the detected actual water supply time and the preset reference time.

When the water pressure of each of the water supply valves 151 and 152 is determined as abnormal (low pressure), the controller 200 may adjust the water supply operation time for each water supply valve based on the difference between the actual water supply time and the reference time. Furthermore, the controller 200 may update the previously stored water pressure information by storing the changed water pressure and adjusted water supply operation time for each water supply valve in the memory 220.

Examples of water supply time adjustment will now be described.

Figure 7:
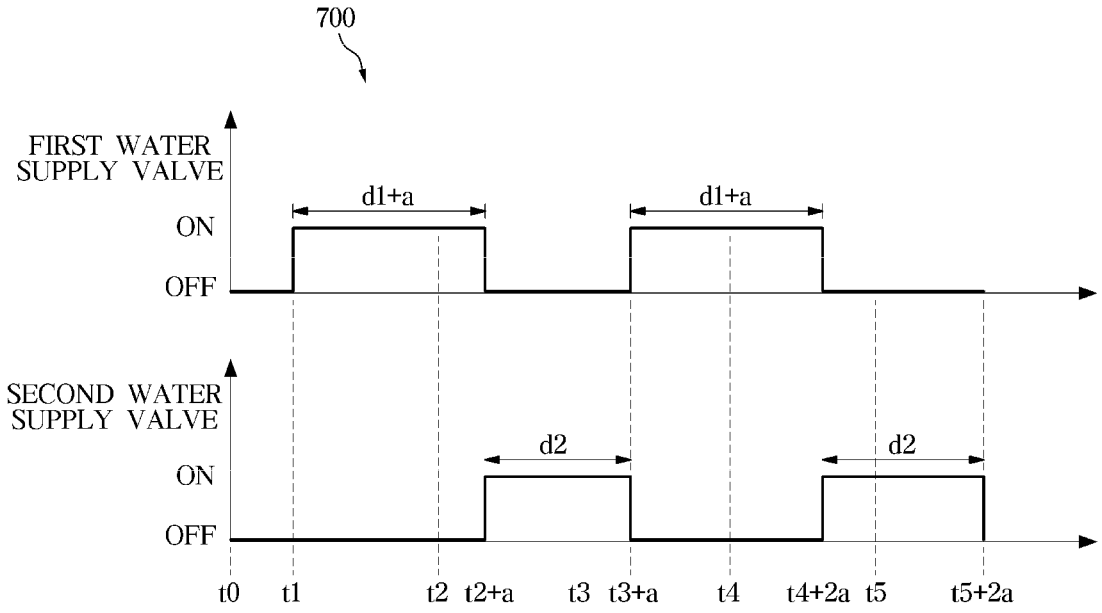
FIG. 7 illustrates graphs for describing a method of adjusting water supply operation time of a water supply valve based on variation in water pressure.

FIG. 7 illustrates graphs 700 for describing a method of adjusting water supply operation time for a water supply valve based on variation in water pressure.

The graphs 700 of FIG. 7 illustrate an example of adjusting the water supply time for the water supply operation based on the first water supply valve 151 determined as having abnormal water pressure. In the case that the water pressure of the first water supply valve 151 is determined as abnormal (low pressure), the controller 200 of the washing machine 100 may increase the first water supply operation time for the first water supply valve 151.

As described in connection with FIG. 6, when the water pressure of the first water supply valve 151 and the water pressure of the second water supply valve 152 are in a normal range, the water level in the tub 120 reaches the target water level by opening the first water supply valve 151 for the first water supply operation time 2*d1 and opening the second water supply valve 152 for the second water supply operation time 2*d2. In this case, the actual water supply time may correspond to the preset reference time.

On the other hand, when the water pressure of the first water supply valve 151 is below the normal range, the amount of water supplied into the tub 120 through the first water supply valve 151 per unit time is reduced. In this case, even when the first water supply valve 151 is opened for the first water supply operation time 2*d1, the water level in the tub 120 may not reach the target water level. In other words, as water needs to be additionally supplied by opening the first water supply valve 151 for a longer period of time to supply water up to the target water level, the actual water supply time that uses the first water supply valve 151 may be longer than the reference time.

The controller 200 of the washing machine 100 may increase the first water supply operation time for the first water supply valve 151 based on an offset value (a) corresponding to a change in water pressure. The offset value (a) refers to a time compensation valve corresponding to a difference between the actual water supply time and the reference time. Referring to FIG. 7, the controller 200 may increase a time section for opening the first water supply valve 151 to d1+a. As the water pressure of the second water supply valve 152 is in the normal range, the second water supply operation time for the second water supply valve 152 may not be changed.

When the first water supply valve 151 is opened and closed twice each during the water supply operation, the first water supply operation time for the first water supply valve 151 increases to 2*(d1+a). The water supply time required from start to finish of the water supply operation may also increase by 2a. The water supply time changed by adjustment of the first water supply operation time for the first water supply valve 151 corresponds to a time length from time t1 to time t5+2a. For example, the changed water supply time may be 14 minutes.

Notification about abnormal water pressure and the first water supply operation time for the first water supply valve 151 may be displayed on the control panel 110 of the washing machine 100. Furthermore, the controller 200 of the washing machine 100 may transmit the notification information to the external user device 3 by controlling the communication interface 190. On receiving the notification information, the external user device 3 may display the notification about the abnormal water pressure and adjustment of the first water supply time for the first water supply valve 151.

Figure 8:
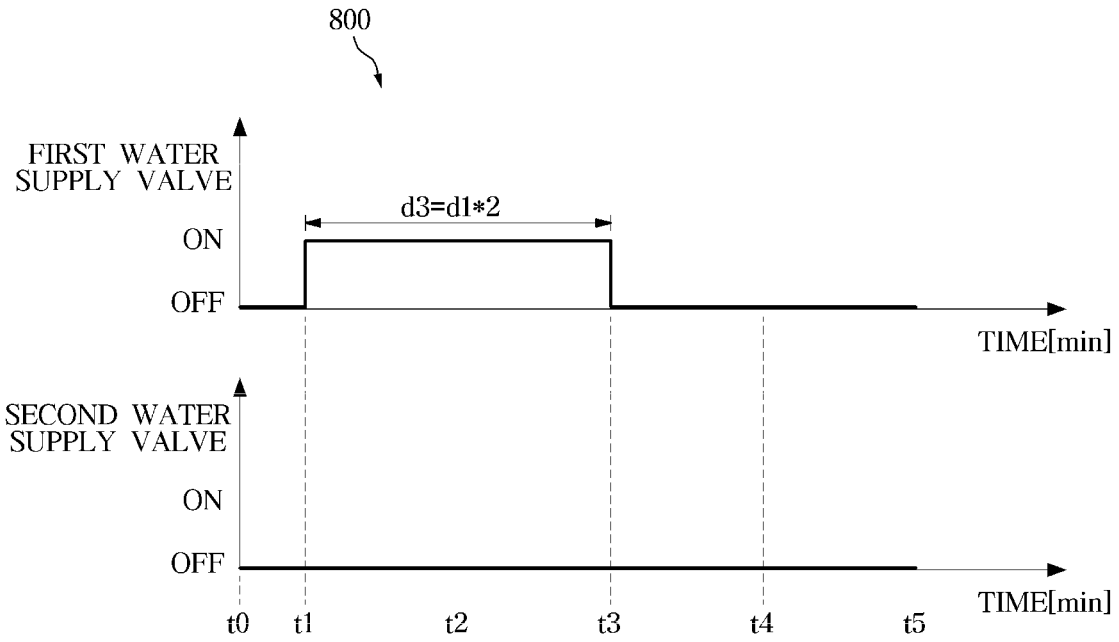
FIG. 8 illustrates graphs for describing a method of controlling a water supply valve that may be operated when another water supply valve is in an abnormal state.

FIG. 8 illustrates graphs for describing a method of controlling a water supply valve that may be operated when another water supply valve is in an abnormal state.

The controller 200 of the washing machine 100 may not only determine whether the water pressure of each of the water supply valves 151 and 152 is normal but also detect an abnormal state of each of the plurality of water supply valves 151 and 152. The controller 200 may determine that the at least one water supply valve is in an abnormal state based on the water level in the tub 120 not increasing after the start of water supply through the at least one water supply valve.

For example, in a case that the first water supply valve 151 is opened and the second water supply valve 152 is closed, the water level in the tub 120 may increase. However, in a case that the second water supply valve 152 is opened and the first water supply valve 151 is closed, the water level in the tub 120 may not increase. In this case, the controller 200 may determine that the second water supply valve 152 is in an abnormal state.

The abnormal state of the second water supply valve 152 may include a state in which opening of the second water supply valve 152 is not possible and/or a state in which no water is supplied to the second water supply valve 152 from an external water supply source. When the external water supply source is locked by the user, water may not be supplied into the tub 120 even though the second water supply valve 152 has no error.

The controller 200 may determine to continue to use the first water supply valve 151 based on the abnormal state of the second water supply valve 152. Referring to the graphs 800 of FIG. 8, the first water supply valve 151 may be continuously opened for a time section d3 from time t1 to time t3 during the water supply operation. The time section d2 for opening the second water supply valve 152 may be eliminated. When the second water supply valve 152 is unavailable, the time section d2 for opening the second water supply valve 152 as described in FIG. 6 is not required. The controller 200 may eliminate the unnecessary time section d2 and change the next time to open the first water supply valve 151 to time t2. Accordingly, the first water supply valve 151 may be continuously opened. The time section d3 of FIG. 8 may be equal to the first water supply operation time 2*d1 for the first water supply valve 151 as described in FIG. 6.

The washing machine 100 may provide the user with a notification about an abnormal state of at least one water supply valve. For example, the controller 200 of the washing machine 100 may control the control panel 110 to display the abnormal state information of the second water supply valve 152. Furthermore, the controller 200 may control the communication interface 190 to transmit the abnormal state information of the second water supply valve 152 to the external user device 3.

The user may check the abnormal state information of the second water supply valve 152, and inspect the state of the second water supply valve 152. When the second water supply valve 152 has no error but the external water supply source is locked by the user, the user may unlock the external water supply source to allow water to be supplied through the second water supply valve 152.

The user may input a command to use or prevent using the second water supply valve 152 by manipulating the control panel 110 or the external user device 3. The controller 200 of the washing machine 100 may determine that the abnormal state of the second water supply valve 152 is resolved and control the second water supply valve 152 for supplying water, in response to reception of the command to use the second water supply valve 152. The controller 200 may determine to continue to use the first water supply valve 151 based on reception of the command to prevent the use of the second water supply valve 152.

Figure 9:
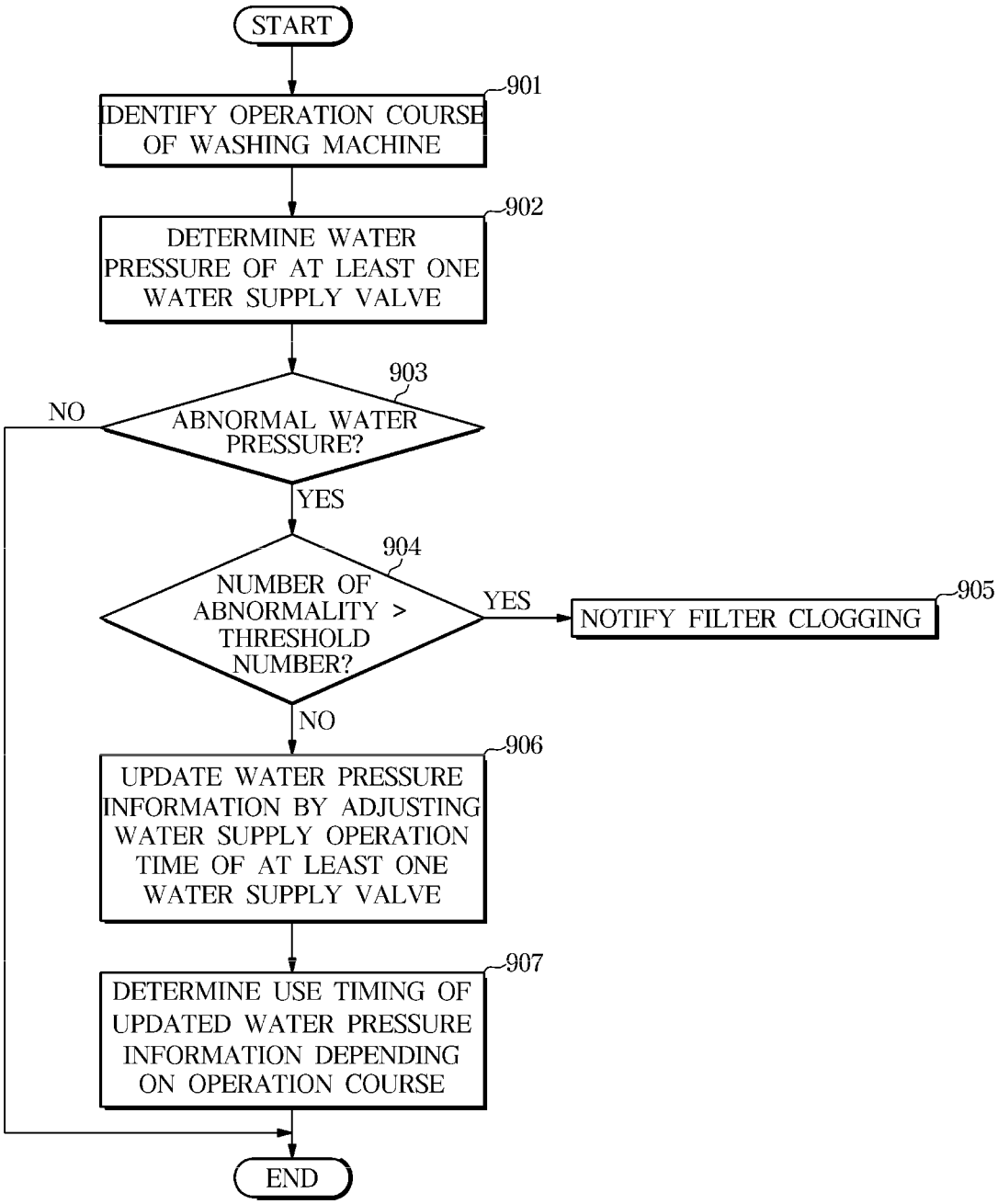
FIG. 9 is a flowchart schematically describing a method of controlling a washing machine, according to an embodiment of the disclosure.

FIG. 9 is a flowchart schematically describing a method of controlling a washing machine, according to an embodiment.

Referring to FIG. 9, the controller 200 of the washing machine 100 may identify an operation course, in 901. The operation course may be determined based on a selection input received through the control panel 110 or the external user device 3. For example, the operation course may include various courses such as a tub cleaning course, a washing course, a rinsing course and a drying course.

The controller 200 may determine water pressure of at least one of the plurality of water supply valves 151 and 152 and determine whether the water pressure is normal, in 902. The controller 200 may store the accumulated number of times of determining that the water pressure of the at least one water supply valve is abnormal in the memory 220 based on the water pressure of the at least one water supply valve determined as abnormal. The determining of whether the water pressure is abnormal may be performed for each water supply valve, and the accumulated number of times of determining that the water pressure is abnormal may also be counted for each water supply valve.

The controller 200 may determine whether the accumulated number of times of determining that the water pressure is abnormal exceeds a preset threshold number, in 904. When the accumulated number of times of determining that the water pressure is abnormal exceeds the preset threshold number, the controller 200 may determine whether a filter associated with the water supply valve is clogged and control the control panel 110 to output a notification about the clogging of the filter 905. Furthermore, the controller 200 may control the communication interface 190 to transmit the notification information about clogging of the filter to the external user device 3. When no filter is included in the water supplier 150 of the washing machine 100, a procedure for determining filter clogging may be skipped.

Based on the water pressure of at least one water supply valve determined as abnormal, the controller 200 may adjust the water supply operation time for the at least one water supply valve and update the water pressure information by storing the adjusted water supply operation time, in 903 and 906. Furthermore, the controller 200 may determine when to use the updated water pressure information depending on the operation course. For example, the water pressure information updated in the tub cleaning course may be set to be used in a washing course of clothes or a rinsing course of clothes to be performed next. The water pressure information updated in the washing course or the rinsing course may be set to be used in a scheduled water supply operation while the washing course of the clothes or the rinsing course of the clothes is being performed.

Figure 10:
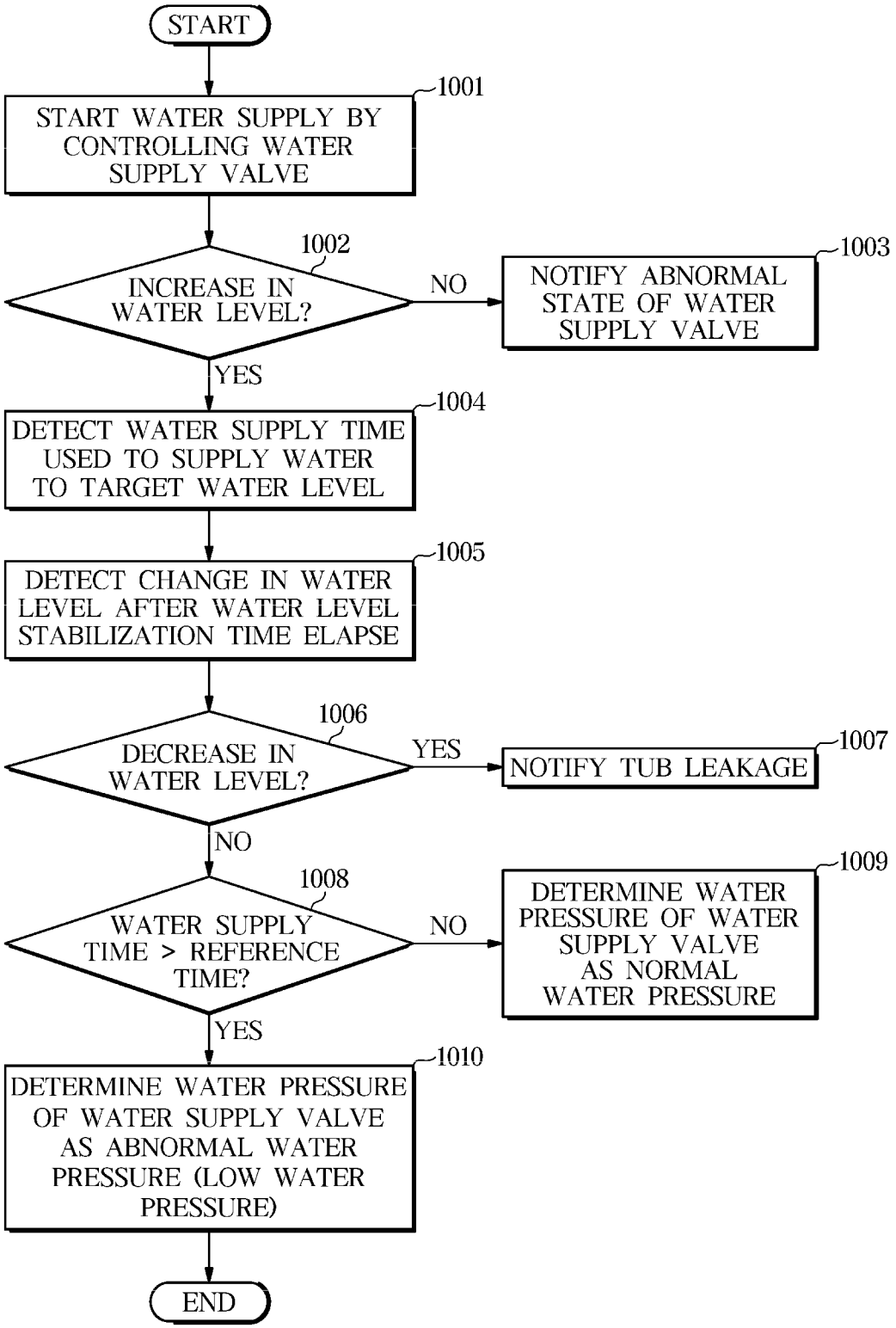
FIG. 10 is a flowchart describing a method of determining water pressure described in FIG. 9 in more detail.

FIG. 10 is a flowchart describing a method of determining water pressure described in FIG. 9.

Referring to FIG. 10, the controller 200 may start a water supply operation by controlling at least one of the plurality of water supply valves 151 and 152 to supply water up to the preset target water level according to the operation course, in 1001. The controller 200 may control at least one of the first water supply valve 151 and the second water supply valve 152 based on the water pressure information stored in the memory 220. The water pressure information includes water pressure of each of the plurality of water supply valves 151 and 152 and corresponding water supply operation time. Each of the plurality of water supply valves 151 and 152 may be controlled to be opened for the water supply operation time in the water pressure information.

The controller 200 may monitor whether the water level in the tub 120 increases after the start of water supply, in 1002. The controller 200 may determine that the water supply valve is in an abnormal state based on the water level in the tub 120 not increasing after the start of water supply. The abnormal state of the first water supply valve 151 and the abnormal state of the second water supply valve 152 may be determined separately. Furthermore, the controller 200 may control the control panel 110 to provide a notification about the abnormal state of the water supply valve, in 1003. The notification about the abnormal state of the water supply valve may also be provided through the external user device 3. Based on the abnormal state of at least one water supply valve, the controller 200 may determine to continuously use the other water supply valve.

The controller 200 may detect an actual water supply time used to supply water up to the preset target water level through each of the plurality of water supply valves 151 and 152 after the start of water supply, in 1004. Furthermore, the controller 200 may detect a change in water level after a preset stabilization time elapses from when the water level in the tub 120 reaches the target water level, in 1005.

The controller 200 may determine tub leakage based on a decrease in water level after the stabilization time elapses, in 1006. When there is a crack on the tub 120, the water level increases with water supplied but the water level may decrease after the water supply is completed. The controller 200 may control the control panel 110 to output a notification about the tub leakage. Furthermore, the controller 200 may control the communication interface 190 to transmit the notification information about the tub leakage to the external user device 3, in 1007. When the water level remains the same even after the stabilization time elapses, whether water pressure of each of the water supply valves 151 and 152 is normal may be determined.

The controller 200 may determine whether the water pressure of each of the water supply valves 151 and 152 is normal by comparing an actual water supply time and the preset reference time. For example, when the actual water supply time used to supply water up to the preset target water level after the start of water supply through the first water supply valve 151 is equal to or shorter than the reference time within a preset error range, the controller 200 may determine that the water pressure of the first water supply valve 151 is abnormal in 1008 and 1009.

On the contrary, when the actual water supply time used to supply water up to the preset target water level after the start of water supply through the first water supply valve 151 is longer than the reference time, the controller 200 may determine that the water pressure of the first water supply valve 151 is abnormal (i.e., low pressure) in 1008 and 1010.

Figure 11:
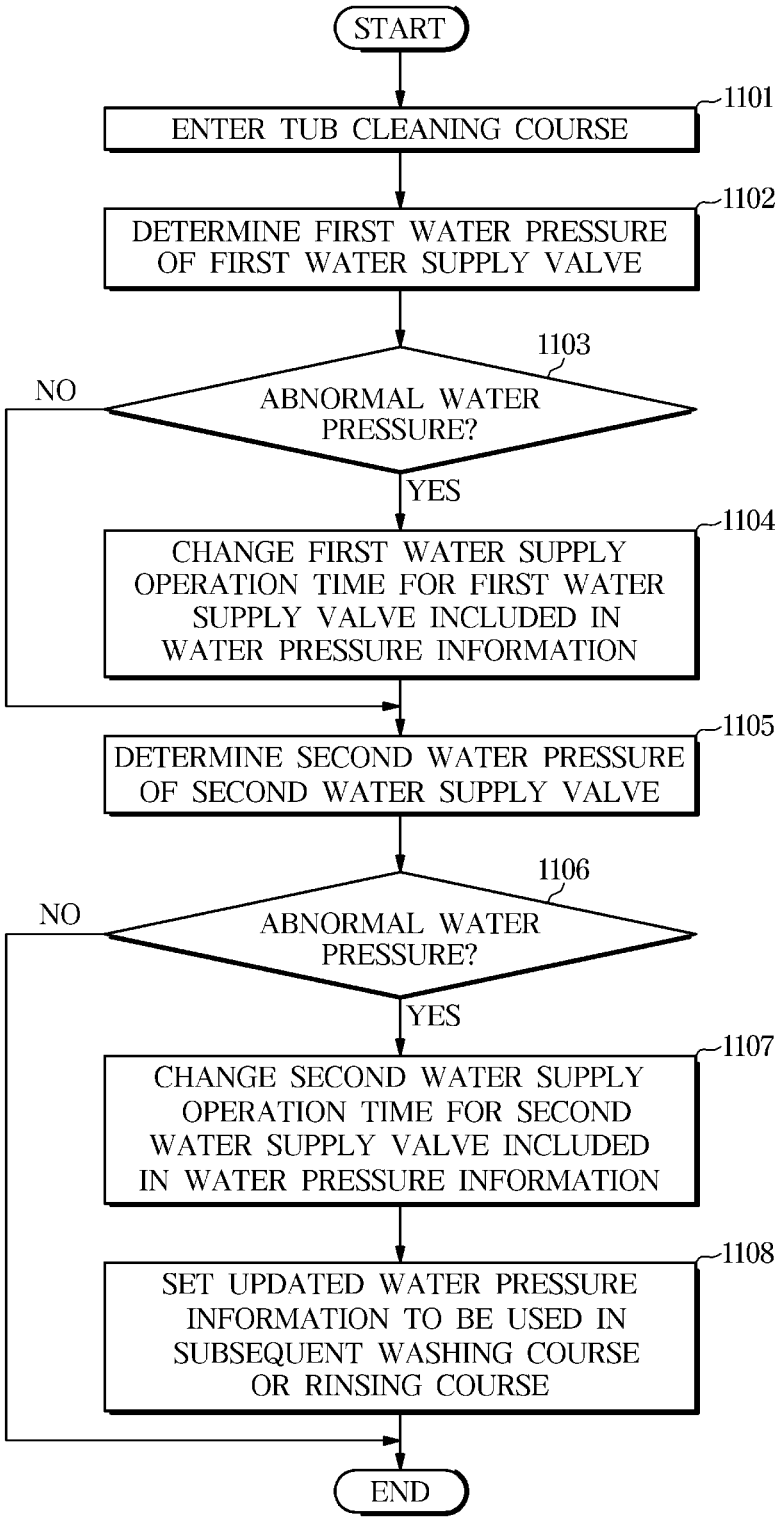
FIG. 11 is a flowchart describing the method of controlling the washing machine of FIG. 9 in detail in a case that a tub cleaning course is performed.

FIG. 11 is a flowchart describing the method of controlling the washing machine of FIG. 9 in detail in a case that a tub cleaning course is performed.

Referring to FIG. 11, the controller 200 of the washing machine 100 may enter a tub cleaning course for cleaning the tub 120, in 1101. The tub cleaning course may be performed in an unloaded state in which no laundry is contained in the drum 130. In the tub cleaning course, all the plurality of water supply valves 151 and 152 may be determined whether they have normal water pressure.

First, the controller 200 may determine first water pressure of the first water supply valve 151 in 1102 and determine whether the first water pressure is normal in 1103. To determine the water pressure of the first water supply valve 151, the second water supply valve 152 is closed. The controller 200 may detect first actual water supply time used to supply water up to the preset target water level through the first water supply valve 151, and determine whether the first water pressure is normal by comparing the detected first actual water supply time and the preset reference time.

When the first water pressure of the first water supply valve 151 is determined as abnormal, the controller 200 may change the first water supply operation time for the first water supply valve 151 included in the water pressure information stored in the memory 220, in 1104. The controller 200 may adjust the first water supply operation time for the first water supply valve 151 based on a difference between the first actual water supply time and the reference time. For example, the first actual water supply time may be stored as a new first water supply operation time. After change of the water pressure information is completed, the controller 200 may perform a drain operation.

The controller 200 may determine second water pressure of the second water supply valve 152 in 1105, and determine whether the second water pressure is normal in 1106. To determine the water pressure of the second water supply valve 152, the first water supply valve 151 is closed. The controller 200 may detect second actual water supply time used to supply water up to the preset target water level through the second water supply valve 152, and determine whether the second water pressure is normal by comparing the detected second actual water supply time and the preset reference time.

When the second water pressure of the second water supply valve 152 is determined as abnormal, the controller 200 may change the second water supply operation time for the second water supply valve 152 included in the water pressure information stored in the memory 220, in 1107. The controller 200 may adjust the second water supply operation time for the second water supply valve 152 based on a difference between the second actual water supply time and the reference time. For example, the second actual water supply time may be stored as a new second water supply operation time. When the change of the water pressure information is completed, the controller 200 may perform a drain operation.

The controller 200 may set the water pressure information updated in the tub cleaning course to be used in the next washing course of clothes or a rinsing course of the clothes, in 1108. The washing machine 100 may prevent performance degradation in the washing course or rinsing course by performing the washing course or rinsing course using the water pressure information updated in the tub cleaning course, and provide the user with more accurate operation time.

The tub cleaning course may be periodically performed, and accordingly, the water pressure information of the plurality of water supply valves 151 and 152 may also be periodically updated.

Figure 12:
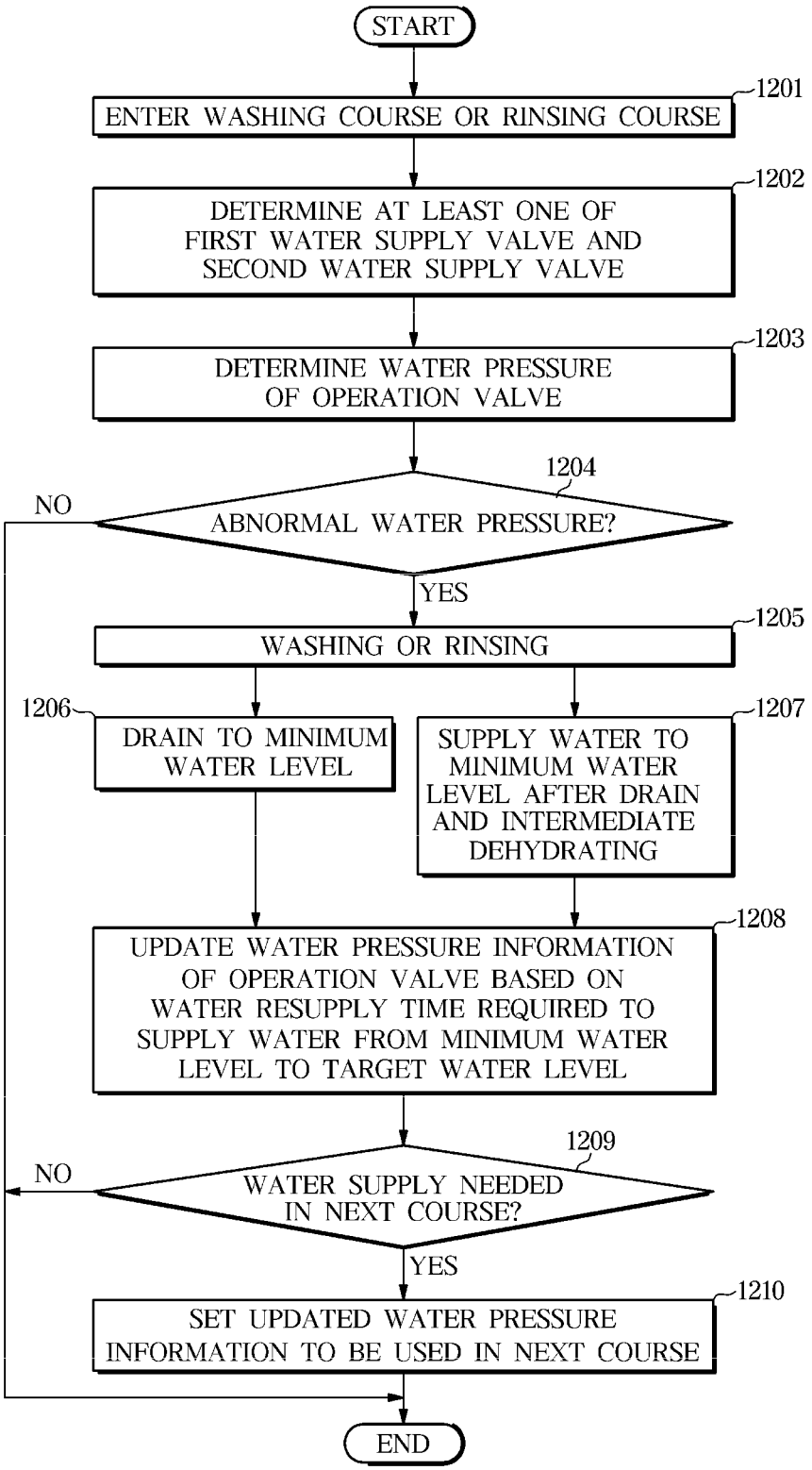
FIG. 12 is a flowchart describing the method of controlling the washing machine of FIG. 9 in detail in a case that a washing course or a rinsing course is performed.

FIG. 12 is a flowchart describing the method of controlling the washing machine of FIG. 9 in detail in a case that a washing course or a rinsing course is performed.

Referring to FIG. 12, based on entering the washing course or rinsing course of clothes in 1201, the controller 200 of the washing machine 100 may determine at least one of the plurality of water supply valves 151 and 152 as an operation valve for the water supply operation in 1202. For example, the first water supply valve 151 and the second water supply valve 152 may be determined as the operation valve, and may be opened in rotation. In another example, only the first water supply valve 151 or only the second water supply valve 152 may be determined as the operation valve.

The controller 200 may detect an abnormal water pressure event based on the water pressure of the at least one water supply valve determined as the operation valve in the first water supply operation of the washing course or rinsing course, in 1203 and 1204. For example, when water is running simultaneously from a tap located in a place such as kitchen or bathroom during the water supply operation of the washing machine 100, the abnormal water pressure event may occur in the washing machine 100.

When the first water supply valve 151 and the second water supply valve 152 are all determined as the operation valve, the first water supply valve 151 and the second water supply valve 152 may be opened in rotation to perform the water supply operation. When the actual water supply time used to complete the water supply operation after the start of water supply is different from the reference time, the controller 200 may identify that the abnormal water pressure event occurs with respect to the at least one water supply valve. The reference time may refer to the previous water supply time stored in the memory 220. Whether the abnormal water pressure event occurs may be detected for each of the first water supply valve 151 and the second water supply valve 152.

The controller 200 may store the abnormal water pressure event of the operation valve in the memory 220 and perform the washing operation or rinsing operation, in 1205.

The controller 200 may change an operation following the washing operation or rinsing operation based on occurrence of the abnormal water pressure event. For example, the controller 200 may perform a drain operation to a preset minimum water level after finishing the washing operation or rinsing operation, in 1206. In another example, the controller 200 may perform a drain operation and an intermediate dehydrating operation after the washing or rinsing operation, and control at least one of the first water supply valve 151 and the second water supply valve 152 to supply water up to the preset minimum water level, in 1207.

The washing course or rinsing course is performed while the drum 130 contains the laundry, so the water level measurement may be started in a state in which the laundry is sufficiently soaked in water to accurately measure the rate of increase in water level. In other words, the controller 200 may measure water resupply time actually used to resupply water from the minimum water level to a target water level to accurately determine the water pressure of the water supply valves 151 and 152. The minimum water level may be determined depending on the amount of the laundry.

When the first water supply valve 151 and the second water supply valve 152 are all determined as the operation valve, the water supply operation times for the first water supply valve 151 and the second water supply valve 152 may be adjusted sequentially. The controller 200 may update the water pressure information by adjusting the water supply operation time for each of the first water supply valve 151 and the second water supply valve 152.

For example, the controller 200 may detect a first water resupply time used to resupply water from the minimum water level to a first target water level through the first water supply valve 151, and adjust the first water supply operation time for the first water supply valve 151 based on the first water resupply time. A first offset value corresponding to the first water resupply time is stored in the memory 220. The controller 200 may use the first offset value to adjust the first water supply operation time for the first water supply valve 151.

Next, the controller 200 may detect a second water resupply time used to supply water from the first target water level to a second target water level through the second water supply valve 152, and adjust the second water supply operation time for the second water supply valve 152 based on the second water resupply time. The second target water level may be set to be higher than the first target water level. A second offset value corresponding to the second water resupply time is stored in the memory 220. The controller 200 may use the second offset value to adjust the second water supply operation time for the second water supply valve 152.

When the water supply operation is required in the subsequent process, the controller 200 may set the updated water pressure information to be used right away in a scheduled water supply operation, in 1209 and 1210. In other words, the water pressure information updated in the current washing course or current rinsing course may be used right away.

As described above, a washing machine and method for controlling the washing machine as disclosed herein may prevent degradation of laundry performance and provide whole operation time of the washing machine or time left until completion of the operation of the washing machine more accurately by adjusting water supply operation time of each of the plurality of water supply valves in consideration of a change in water pressure.

Furthermore, in the disclosure, water pressure of each of the plurality of water supply valves may be determined without an extra flowmeter, and even an abnormal state of the water supply valve, clogging of filters and tub leakage may be detected in the process of determination of the water pressure and notified to the user.

Meanwhile, the embodiments of the disclosure may be implemented in the form of a recording medium for storing instructions to be carried out by a computer. The instructions may be stored in the form of program codes, and when executed by a processor, may generate program modules to perform operations in the embodiments of the disclosure. The recording media may correspond to computer-readable recording media.

The computer-readable recording medium includes any type of recording medium having data stored thereon that may be thereafter read by a computer. For example, it may be a read only memory (ROM), a random access memory (RAM), a magnetic tape, a magnetic disk, a flash memory, an optical data storage device, etc.

The computer-readable storage medium may be provided in the form of a non-transitory storage medium. The term 'non-transitory storage medium' may mean a tangible device without including a signal, e.g., electromagnetic waves, and may not distinguish between storing data in the storage medium semi-permanently and temporarily. For example, the non-transitory storage medium may include a buffer that temporarily stores data.

In an embodiment of the disclosure, the aforementioned method according to the various embodiments of the disclosure may be provided in a computer program product. The computer program product may be a commercial product that may be traded between a seller and a buyer. The computer program product may be distributed in the form of a storage medium (e.g., a compact disc read only memory (CD-ROM)), through an application store (e.g., Play Store™) directly between two user devices (e.g., smart phones), or online (e.g., downloaded or uploaded). In the case of online distribution, at least part of the computer program product (e.g., a downloadable app) may be at least temporarily stored or arbitrarily created in a storage medium that may be readable to a device such as a server of the manufacturer, a server of the application store, or a relay server.

The embodiments of the disclosure have thus far been described with reference to accompanying drawings. It will be obvious to people of ordinary skill in the art that the present disclosure may be practiced in other forms than the embodiments as described above without changing the technical idea or essential features of the present disclosure. The above embodiments are only by way of example, and should not be interpreted in a limited sense.

What is claimed is:

1. A washing machine comprising:

a tub;

a water supply valve configured to open or close a flow path to supply water to the tub;

a memory storing water pressure information that includes water supply operation time of the water supply valve; and a controller configured to:

control the water supply valve to supply water to the tub to a target water level, determine whether water pressure of the water supplied by the water supply valve is abnormal based on supplying the water to the tub to the target water level, based on determining that the water pressure of the water supply valve is abnormal, update the water pressure information stored in the memory by adjusting the water supply operation time, and use the updated water pressure information stored in the memory to control the water supply valve in an operation course of the washing machine.

2. The washing machine of claim 1, wherein the controller is configured to:

enter a tub cleaning course, based on the washing machine being in the tub cleaning course, control of the water supply valve to supply water to the tub to the target water level, determine whether the water pressure of the water supplied by the water supply valve is abnormal based on supplying the water to the tub to the target water level, and update the water pressure information stored in the memory by adjusting the water supply operation time.

3. The washing machine of claim 2, wherein the operation course is a washing course of clothes or a rinsing course of clothes performed after the tub cleaning course.

4. The washing machine of claim 1, wherein the controller is configured to:

detect time taken to supply the water to the target water level after start of water supply through the water supply valve, and determine whether the water pressure of the water supplied by the water supply valve is abnormal based on the detected time.

5. The washing machine of claim 1, wherein the controller is configured to:

update the water pressure information stored in the memory during performance of a washing course of clothes or a rinsing course of clothes, and use the updated water pressure information stored in the memory in a subsequent water supply operation within the washing course or the rinsing course.

6. The washing machine of claim 1, wherein the controller is configured to:

perform a drain operation to a preset minimum water level based on determining that the water pressure of the water supply valve is abnormal, detect time taken to supply water from the preset minimum water level to the target water level, and adjust the water supply operation time of the water supply valve based on the detected time.

7. The washing machine of claim 1, wherein the water supply valve includes a plurality of water supply valves, and the controller is configured to:

based on determining that the water pressure of the water supplied by at least one of the plurality of water supply valves is in an abnormal state, increase a water supply operation time of at least one of the other water supply valves not in the abnormal state.

8. The washing machine of claim 1, further comprising:

a filter in the flow path to filter foreign materials in the water, wherein the controller is configured to:

store an accumulated number of times of determining that water pressure of the water supply valve is abnormal, and determine that the filter is clogged based on the accumulated number of times exceeding a threshold number.

9. The washing machine of claim 1, wherein the controller is configured to:

determine that the tub has a leak based on reduction in water level after a preset stabilization time elapses from when the water level in the tub reaches the target water level.

10. The washing machine of claim 1, further comprising:

a communication interface configured to communicate with an external user device, wherein the controller is configured to:

control the communication interface to provide a notification about abnormal water pressure of the water supply valve and adjustment of the water supply operation time.

11. A method of controlling a washing machine including a tub, a water supply valve configured to open or close a flow path to supply water to the tub, a memory storing water pressure information that includes water supply operation time of the water supply valve, and a controller, the method comprising:

by the controller, controlling the water supply valve to supply water to the tub to a target water level;

determining whether water pressure of the water supplied by the water supply valve is abnormal based on supplying the water to the tub to the target water level;

based on determining that the water pressure of the water supply valve is abnormal, updating the water pressure information stored in the memory by adjusting the water supply operation time; and using the updated water pressure information stored in the memory to control the water supply valve in an operation course of the washing machine.

12. The method of claim 11, further comprising:

by the controller, entering a tub cleaning course, based on the washing machine being in the tub cleaning course, controlling of the water supply valve to supply water to the tub to the target water level, determining whether the water pressure of the water supplied by the water supply valve is abnormal based on supplying the water to the tub to the target water level, and updating the water pressure information stored in the memory by adjusting the water supply operation time.

13. The method of claim 12, wherein the operation course is a washing course of clothes or a rinsing course of clothes to be performed after the tub cleaning course.

14. The method of claim 11, wherein the determining whether the water pressure is abnormal includes:

detecting time taken to supply water to the target water level after start of water supply through the water supply valve, and determining whether the water pressure of the water supplied by of the water supply valve is abnormal based on the detected time.

15. The method of claim 11, further comprising:

updating the water pressure information stored in the memory during performance of a washing course of clothes or a rinsing course of clothes, and using the updated water pressure information stored in the memory in a subsequent scheduled water supply operation within the washing course or the rinsing course.

16. The method of claim 14, the determining includes:

determining whether the water pressure of the water supplied by the water supply valve is abnormal based on by comparing the detected time and a reference time included in the water pressure information.

17. The washing machine of claim 4, wherein the controller is configured to determine whether the water pressure of the water supplied by the water supply valve is abnormal based on comparing the detected time and a reference time included in the water pressure information.

18. The method of claim 11, further comprising:

performing a drain operation to a preset minimum water level based on determining that the water pressure of the water supply valve is abnormal, detecting time taken to supply water from the preset minimum water level to the target water level, and adjusting the water supply operation time of the water supply valve based on the detected time.

19. The method of claim 11, wherein the water supply valve includes a plurality of water supply valves, and the updating includes:

based on determining that the water pressure of the water supplied by at least one of the plurality of water supply valves is in an abnormal state, increasing a water supply operation time of at least one of the other water supply valves not in the abnormal state.

20. The method of claim 11, wherein the washing machine further comprises a filter in the flow path to filter foreign materials in the water, and the method further comprising:

storing an accumulated number of times of determining that water pressure of the water supply valve is abnormal, and determining that the filter is clogged based on the accumulated number of times exceeding a threshold number.

* * * * *